US005565642A

United States Patent [19]

Heitz

[11] Patent Number: 5,565,642

[45] Date of Patent: Oct. 15, 1996

[54] COMPRESSED GAS WEAPON

[75] Inventor: Walter Heitz, Rastatt, Germany

[73] Assignee: Mayer & Grammelspacher Dianawerk GmbH & Co. KG, Rastatt, Germany

[21] Appl. No.: 306,684

[22] Filed: Sep. 15, 1994

Related U.S. Application Data

[63] Continuation-in-part of PCT/EP93/00544, Mar. 10, 1993, published as WO93/19341, Sep. 30, 1993.

[30] Foreign Application Priority Data

Mar. 16, 1992 [DE] Germany ..... 42 08 416.4

[51] Int. Cl.[6] ..... F41A 9/23; F41A 21/18; F41A 1/00

[52] U.S. Cl. ..... 89/7; 89/14.05; 89/33.03; 42/78; 42/17; 42/21; 42/65

[58] Field of Search ..... 89/14.05, 47, 7, 89/33.03; 42/76.01, 78, 17, 18, 21, 22, 65

[56] References Cited

U.S. PATENT DOCUMENTS

| | | | |
|---|---|---|---|
| 1,817,273 | 8/1931 | Schuler . | |
| 2,699,008 | 1/1955 | Tyler . | |
| 2,798,413 | 7/1957 | Fowler | 89/1.7 |
| 2,831,287 | 4/1958 | Maillard | 42/76.01 |
| 2,849,924 | 9/1958 | Nutting et al. | 89/47 |
| 2,918,868 | 12/1959 | Ringdal . | |
| 3,474,560 | 10/1969 | Ramsay | 42/17 |
| 3,722,123 | 3/1973 | Parisi | 42/16 |
| 4,004,566 | 1/1977 | Fischer | 124/59 |
| 4,005,660 | 2/1977 | Pichard | 273/106 E |
| 4,047,466 | 9/1977 | Berman | 89/14.05 |
| 4,282,813 | 8/1981 | Sterbutzel | 102/431 |
| 4,697,523 | 10/1987 | Saxby | 42/16 |
| 4,712,465 | 12/1987 | MacDonald | 89/16 |

FOREIGN PATENT DOCUMENTS

| | | |
|---|---|---|
| 0158408 | 10/1985 | European Pat. Off. . |
| 0189974 | 8/1986 | European Pat. Off. . |
| 0538733 | 4/1993 | European Pat. Off. . |
| 390702 | 10/1908 | France . |
| 1131272 | 2/1957 | France . |
| 2346665 | 10/1977 | France . |
| 165412 | 10/1904 | Germany . |
| 8802094 | 3/1988 | WIPO . |

*Primary Examiner*—Stephen M. Johnson
*Attorney, Agent, or Firm*—Brumbaugh, Graves, Donohue & Raymond

[57] ABSTRACT

A compressed gas weapon (10) is configured in the breech portion (18) of its barrel (12) to accommodate a projectile (24) in a position of readiness to fire and to reproducibly caliber the projectile (24) in the process of conveying it into the position of readiness to fire.

47 Claims, 10 Drawing Sheets

COMPRESSED GAS WEAPON

The present application is a continuation-in-part of International Patent Application No. PCT/EP93/00544, filed Mar. 10, 1993, and published as WO93/19341 Sep. 30, 1993, which is based on German patent application No. P 42 08 416.4, filed Mar. 16, 1992.

BACKGROUND OF THE INVENTION

The invention relates to a compressed gas weapon having a barrel and a stock. A portion of the barrel distant from the muzzle is configured to receive a projectile in a position of readiness to fire and to caliber the projectile when conveyed into the position of readiness to fire. Conventionally, the ammunition for compressed gas weapons, as seen in a direction perpendicular to the axis of the barrel has a maximum outside diameter that is slightly oversized relative to the bore of the barrel. This excess must be reduced upon introduction of a projectile into the barrel: the projectile is calibered when it is introduced into the barrel. This is intended to ensure that the projectile, in its position of readiness to fire, will obturate the bore in the direction towards the muzzle, so that upon firing, the full gas pressure will contribute to accelerating the projectile, and no portion of the gas will be able to escape past the projectile.

In compressed gas weapons of this kind, it has been found that the location of the impact of the projectile at the target depends critically on the manner in which the projectile was introduced into the barrel. Thus for example different marksmen will obtain different firing patterns, even if the weapon has been trained on the target and clamped down firmly, the trigger is pulled automatically, and only the introduction of the ammunition is done manually. Even the same individual marksman will obtain different patterns depending on whether he places the ammunition in the barrel carefully or carelessly. Users find this situation highly unacceptable.

SUMMARY OF THE INVENTION

One object of the invention is to provide a compressed gas weapon of the kind in question with which, at least when the weapon is firmly clamped down, a firing pattern independent of the user is obtained.

This object is accomplished, according to the invention, in that the compressed gas weapon is configured to caliber the projectile reproducibly. In this way a user-dependent calibration of the projectile (for example because one user, when inserting the projectile in the bore, applies a load preferentially at the upper right for the most part, whereas another user may apply a load for the most part at the lower right) is avoided. Reproducible calibration of the projectile thus ensures that the positions of readiness to fire of the individual projectiles will coincide, if not quite perfectly, at least substantially.

This reproducibility of calibering can be achieved in simple manner by providing a projectile-receiving chamber in the portion of the barrel distant from the muzzle, into which chamber the projectile may be placed substantially without deformation, and by providing a positioning means whereby the projectile may be transferred into the position of readiness to fire.

The calibering may be performed in simple manner by means of a calibering edge fashioned located at the entrance of of the projectile-receiving chamber, across which edge the projectile is moved by the positioning means while being transferred into the position of readiness to fire, so as to caliber it.

Preferably, the positioning means, to transfer the projectile into its position of readiness to fire, reaches into the projectile-receiving chamber, and is guided in the axial direction of the barrel.

In one embodiment, provision is made for the positioning means to be guided in the projectile-receiving chamber. In this way, special structural measures in the compressed gas weapon for guiding the positioning means may be dispensed with. In order thus to be able to prevent an undesired deformation of the projectile in an especially effective manner, it is proposed that the projectile-receiving chamber, the positioning means and the projectile be so coordinated with each other in configuration that the positioning means is securely guided in the projectile-receiving chamber in the axial direction of the bore before it transfers the projectile, with deformation, into the position of readiness to fire.

In an alternative embodiment, however, it is possible instead to guide the positioning means at the stock.

The construction of the compressed gas weapon according to the invention may be simplified by adopting a positioning means in the form of a cartridge, which supplies the compressed gas for accelerating the projectile when fired. In this way, for example a gas compression chamber and a cumbersome winding means for the compression spring may be dispensed with. The cartridge is preferably arranged immediately behind the projectile and may thus at the same time serve as positioning means, so that no separate positioning means is required.

In that case, the reproducibility of calibering of the projectile may be improved by providing a sliding means displaceable back and forth in the axial direction of the barrel and sliding the cartridge out of a position of readiness to load into a position of readiness for discharge, while the cartridge in the position of readiness for discharge holds the projectile in its position of readiness to fire. In this embodiment, the cartridge need merely be placed manually in the position of readiness to load.

For displacement of the sliding means, the latter may for example be operatively connected to a loading flap of the compressed gas weapon, in such a way that when the loading flap is opened, for example in order to place a projectile in the receiving chamber, the sliding means is displaced away from the projectile-receiving chamber, and when the flap is closed it is displaced towards the projectile-receiving chamber. Since in preparing to fire it is necessary both to open the loading flap and to displace the sliding means away from the projectile-receiving chamber, the one in order to be able to place a fresh projectile in the receiving chamber and the other in order to bring a cartridge into the position of readiness to load and then shift the sliding means back to the receiving chamber and close the loading flap once more, the loading cycle of the compressed gas weapon according to the invention can be simplified by coupling the movements of the loading flap and the sliding means.

The cycle of movements in the compressed gas weapon according to the invention may be further simplified by arranging a hook member on the sliding means, which member, when the loading flap is opened after firing a shot, ejects a used cartridge from the projectile-receiving chamber.

If a firing pin is provided in the sliding means to discharge the cartridge, the firing mechanism can be combined with the sliding means in structurally compact form.

To still further simplify the reloading of the compressed gas weapon according to the invention, it is proposed in addition that a magazine device be provided to accommodate a plurality of cartridges.

In that case, a space saving arrangement can be achieved if the magazine device comprises a receptacle in which the plurality of cartridges can be arranged one behind another in the direction of the barrel. The receptacle may for example be arranged under the barrel, thus integrating it into the outward appearance of the weapon in an attractive manner.

In a preferred embodiment, the magazine device comprises a conveying means to convey the plurality of cartridges one at a time from the receptacle into a position of readiness for loading.

The loading may be simplified still further by supplying the projectile and the cartridge as a unit. In manual loading, the cartridge and projectile may then be inserted in place with a single movement.

In order at least to render it difficult to modify the weapon and the ammunition illicitly so as to achieve projectile energies beyond regulated limits, it is proposed that a passage be branched off from the projectile-receiving chamber between its muzzle-near and its muzzle-far end, by way of which the projectile-receiving chamber communicates with the surroundings, and that the cartridge be provided with a weakened area facing the passage when in the position of readiness for discharge.

As a means of preventing some of the compressed gas from escaping in a backward direction from the pressure chamber, it is proposed that a seal be provided between the outer periphery of the cartridge and the inner periphery of the projectile-receiving chamber.

This seal may be achieved in simple manner by jacketing the cartridge in a yielding material, for example plastic. Thus a separate sealing element may be dispensed with. A cartridge of such configuration, furthermore, permits the manufacture of an especially economical and light-weight weapon. For only the barrel of the weapon need be produced with high precision. All other parts of the weapon may be fabricated in light materials, for example plastic, or aluminum, and need not be finished to high precision.

According to another aspect of the invention, its point of departure is a weapon system comprising a firing mechanism having a bore passage, the said bore passage featuring an axis, a projectile exit end, and at an axial distance from the projectile exit end, an entrance for a projectile, and an associated propellant unit to generate a gas pressure driving the projectile in the axial direction of the bore towards the projectile exit end, a trigger device being provided in the firing mechanism, capable of causing the propellant unit to release the compressed gas.

Such a weapon system is disclosed for example in U.S. Pat. No. 3,302,319. In preparation for firing a shot with the known weapon system, a projectile is placed in the entrance. This projectile is of such configuration that it will then obturate the bore towards the projectile exit end. In addition, a compression piston mechanism is loaded in the known manner of conventional compressed gas weapons. When the shot is fired, the compression piston mechanism is released. The pressure built up discharges a propellant unit arranged in a hollow cylinder made in one piece with the projectile and open at its end away from the projectile exit, using the so-called "Diesel" effect. The obturating action of the projectile ensures that the propellant unit will be discharged without fail. The projectile, however, is accelerated towards the projectile exit end only by the compressed gas released from the propellant unit. According to the foregoing, in the known weapon system a projectile of special configuration must be employed. But this is often undesirable or not feasible in the case of compressed gas weapons. Thus for example in competitive target practice, only certain projectiles may be used.

Hence it is another object of the invention to provide a weapon system that can be operated with projectiles of customary type for compressed gas weapons.

This object is accomplished, according to the invention, by providing a cartridge-receiving chamber axially aligned with the bore in the region of the bore entrance, which chamber accommodates a compressed-gas generating cartridge usable for a single shot, in a position behind the projectile in readiness to fire, said compressed-gas generating cartridge containing the propellant unit. Since the projectile and the cartridge are provided, according to the invention, as separate parts, first the projectile and then the cartridge successively are introduced into the cartridge-receiving chamber when loading the system. The weapon system does not impose any special requirements in this way on the configuration of the projectile, so that it may be operated using projectiles of conventional type for compressed gas weapons without more.

In order to ensure that when the compressed gas is released by the propellant unit, an effective gas pressure will build up to accelerate the projectile without any loss of pressure, it is proposed that the cartridge comprise a shell and that facing end portions of the projectile and the shell be configured for mutual contact along an annulus encircling the axis, a gas reservoir being formed inside the said annulus between the facing end portions, and the end portion of the shell having a gas exit orifice opening into the said reservoir.

The gas reservoir may consist simply of a cavity in the projectile at its posterior end and a tapered extension of the shell at its anterior end, the cavity and the tapered extension bounding the gas reservoir between them.

A good sealing effect can be achieved if the cavity or the extension is bounded by a conical surface.

An especially good sealing effect can be achieved if both the cavity and the extension are each bounded by a conical surface. In that case, it is especially preferred that the conical surfaces of the cavity and the extension have coincident tapers over at least a portion of their axial lengths.

In order both to secure a problem-free insertability of the cartridge in the cartridge-receiving chamber and, after the sealing effect has been eliminated by the contact of projectile and cartridge, to ensure a dependable sealing off of the cartridge-receiving chamber, provision is made for the outside diameter of the cartridge to be so matched with the inside diameter of the cartridge-receiving chamber that the cartridge can be smoothly introduced into the cartridge-receiving chamber as well as for the cartridge to be expandable under the action of the gas pressure building up in its interior in such manner that it will make gastight contact with the inner periphery of the cartridge-receiving chamber.

This can be accomplished in simple manner if the shell consists at least in part of plastic.

By positioning of the cartridge in the axial direction of the bore by means of a stop, a reproducible position of the cartridge can be secured.

In order to prevent the projectile, when placed in the cartridge-receiving chamber, from being manually deformed in undesirable manner, and also in order to ensure that the projectile will be located in the bore in its position of readiness to fire, it is proposed that the inside diameter of the cartridge-receiving chamber slightly exceed the maximum diameter of the projectile, so that the projectile will be smoothly insertable in the cartridge-receiving chamber, and that the inside diameter of the bore be smaller than the inside diameter of the cartridge-receiving chamber, the cartridge being capable of advancing the projectile into the bore when the cartridge is introduced into the cartridge-receiving chamber.

If the maximum diameter of the projectile occurs in the region of its posterior end, and this maximum diameter is so matched to the diameter of the bore that when the projectile is advanced into the bore by the cartridge pushing the projectile ahead, the diameter of the posterior end portion of the projectile is diminished, it can be ensured that the outside diameter of the projectile will be matched to the inside diameter of the bore in the position of readiness to fire, which is to say that the projectile will be calibered on being pushed into the bore. The fact that this push is not effected manually but by means of the cartridge can moreover ensure a calibering reproducible from one shot to another.

By configuration of the transition between the cartridge-receiving chamber and the bore as a conical taper, the reproducible calibering of the projectile can be assisted.

When the bore has a smooth cylindrical segment adjacent to the cartridge-receiving chamber, and following this smooth cylindrical segment towards the exit end of the projectile, a rifled segment, an anterior end portion of the projectile being accommodated by the rifled segment and a posterior end portion of the projectile by the smooth cylindrical segment when in position of readiness to fire, the calibering of the projectile and the introduction of the projectile into the rifled segment of the bore may be accomplished successively, so that the forces thereby exerted on the projectile can be kept small, thereby further enhancing the reproducibility of calibering.

In order to ensure that upon introduction into the rifled segment of the bore, the calibering of the projectile will be preserved, and moreover the forces so exerted on the projectile will be as small as possible, it is proposed that the root surface of the rifling be aligned with the inner periphery of the smooth cylindrical segment, and that the lands between grooves of the rifled segment of the bore project slightly radially inward relative to the smooth cylindrical segment and pass over into the smooth cylindrical segment by way of conical transition surfaces.

If the outside diameter of the anterior segment of the projectile is smaller than the diameter of the rifled segment of the bore as defined by the lands, it can be ensured that all deformations of the projectile that are required to caliber the projectile and introduce it into the rifled segment will affect its posterior portion, so that the projectile will move more uniformly when the shot is fired.

The foregoing advantages can be achieved in simple manner by employing a projectile of the diabolo type.

So that the propellant unit may be discharged in simple manner, the triggering device is provided with a firing pin.

Reloading of the weapon system may be simplified for the marksman by providing a magazine for the projectiles, or by providing a magazine for the cartridges, or by providing a magazine to accommodate projectiles and cartridges together.

In any of these possible alternatives, it is preferred for the magazine to be advanceable, bringing the projectiles and/or the cartridges into the position of readiness to fire one after another.

Alternatively, however, it is conceivable that the magazine might be advanceable so as to bring the projectiles and/or the cartridges successively into a position of readiness for insertion. The projectiles and/or the cartridges may then in simple manner be brought out of the position of readiness for insertion into the position of readiness to fire if suitable conveying means are provided for the purpose.

DESCRIPTION OF THE DRAWINGS

The invention will be better understood from the following description of exemplary embodiments, as shown in the accompanying drawings, in which.

DESCRIPTION OF THE EMBODIMENTS

Figure 1:
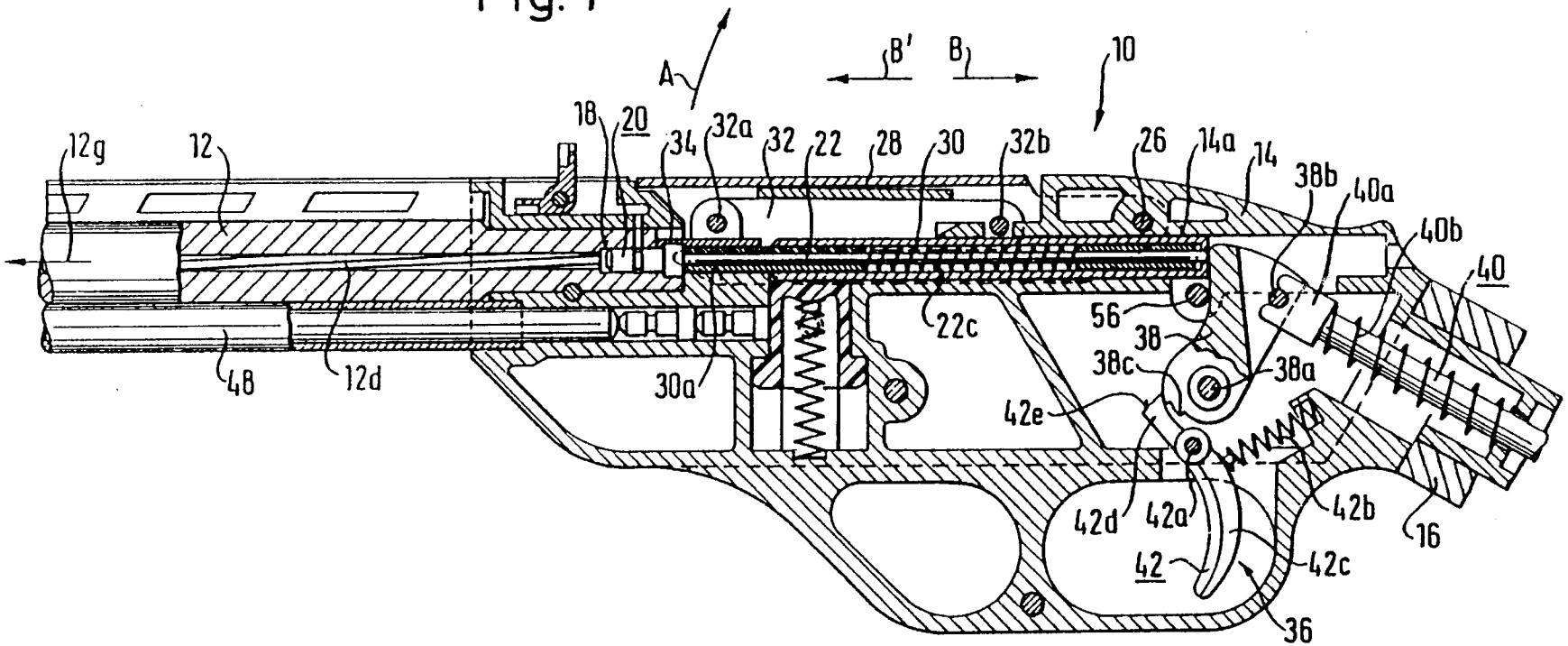
FIG. 1 shows a sectional side view of a compressed gas weapon according to the invention, in condition as fired.

FIG. 1 shows a compressed gas rifle, designated 10, in a condition as fired. The rifle 10 comprises a barrel 12 with a bore **12*d* and a muzzle 12*g*, a breech 14 and a stock 16. In a region 18 of the barrel 12 at a distance from the muzzle, a cartridge 20 is arranged, supplying the propellant gas for shooting. The configuration of the cartridge 20 is the subject of a German published patent application DE 41 35 248 (published Apr. 29, 1994), which is hereby incorporated by reference. In the following, therefore, the cartridge 20** will be discussed only insofar as required.

The cartridge 20 is provided, at its end **20*a* away from the projectile in the condition of readiness to fire (see FIGS. 6 and 7), with a priming cap (not shown) capable of being ignited by a firing pin 22 (see FIG. 1). The gas evolving in consequence of the ignition flows into an expansion chamber defined within the jacket 20*b* of the cartridge, serving to build up and homogenize the pressure. The compressed gas emerges at a preferably tapered head portion 20*c* of the cartridge 20 from a nozzle 20*f* and accelerates a projectile 24 placed in the barrel 12 towards the muzzle of the barrel 12. The nozzle 20*f*** may for example have a diameter of about 2 mm.

Figure 2:
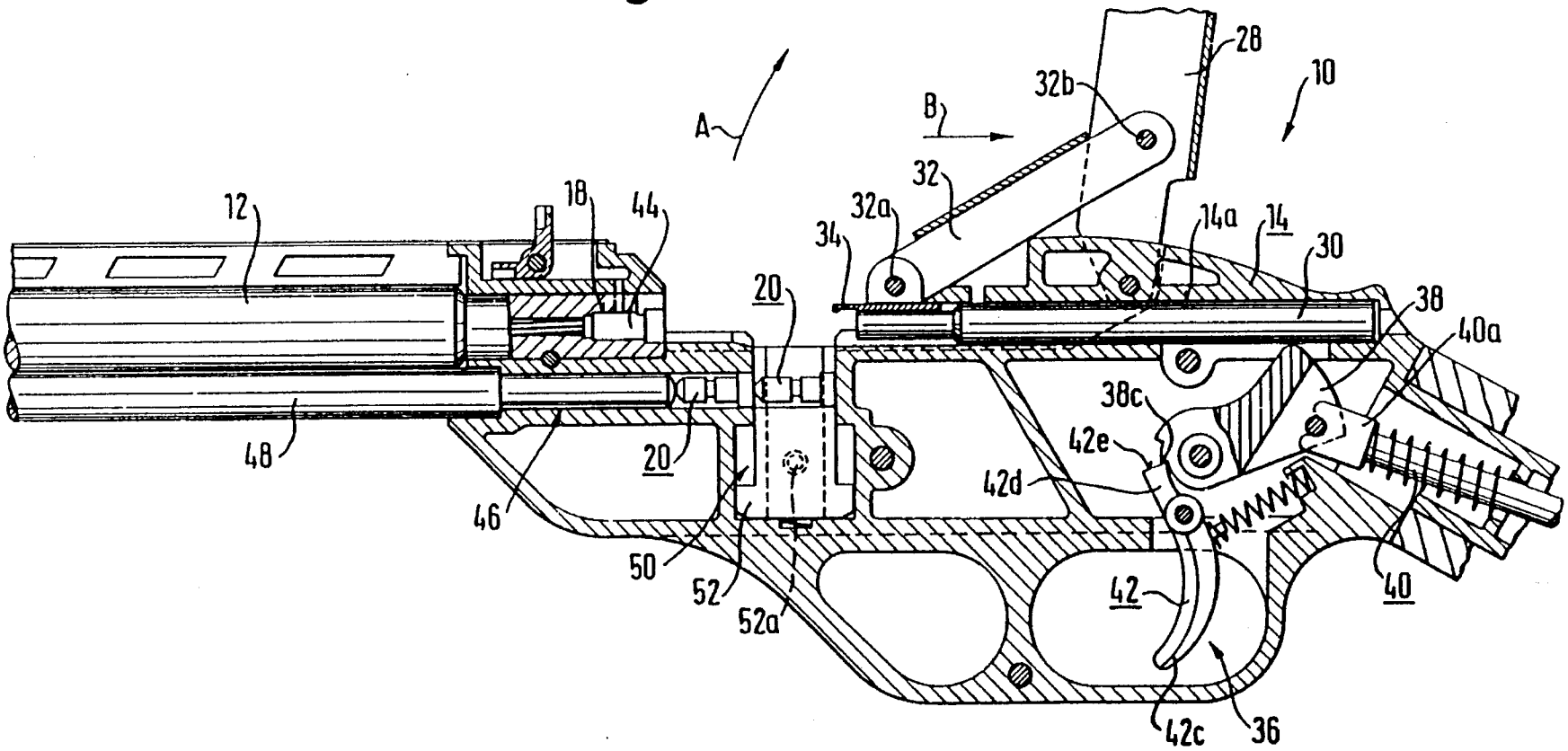
FIG. 2 shows a view similar to FIG. 1, during a first stage of loading the compressed gas weapon.

To reload the weapon 10, first a loading flap 28 hinged to the breech 14 at 26 is swung in the direction of the arrow A (see FIGS. 1 and 2). A closure slide 30 is received for movement back and forth in the direction of the arrows B and B' in a receptacle **14*a* extending substantially parallel to the axis of the barrel 12. The closure slide 30 is operatively connected to the flap 28 by way of a lever 32 and two pins 32***a* and 32*b*, so that the closure slide 30 is shifted in the receptacle 14*a* in the direction of the arrow B, i.e. away from the barrel 12, when the loading flap 20 is opened, i.e. when the flap is swung in the direction of the arrow A.

At the barrel end of the closure slide 30, an extractor hook 34 is arranged, which in the position of FIG. 1 catches a collar 20*d* of the cartridge 20 (see also FIG. 7) and automatically removes the cartridge 20 from the breach region 18 of the barrel 12 when the loading flap is opened.

Furthermore, when the loading flap is opened, a trigger system 36 of the weapon 10 is automatically cocked. The trigger system 36 comprises a hammer 38 pivoted on the breech 14 at 38*a*, a hammer rod 40, and a trigger 42 pivoted on the breech at 42*a*. A head part 40*a* of the hammer rod 40 is in engagement with a pin 38*b* of the hammer 38. A helical compression spring 40*b*, abutting on the breech 14 at one end and on the head 40*a* of the hammer rod at the other end pushes the hammer 38 into the position shown in FIG. 1. A helical compression spring 42*b*, abutting at one end on the breech 14 and on a lower lever arm 42*c*, in FIG. 1, at the other end, presses the trigger 42 forward in such a way that an upper lever arm 42*d*, in FIG. 1, of the trigger 42, comes to rest against the hammer 38.

Figure 4:
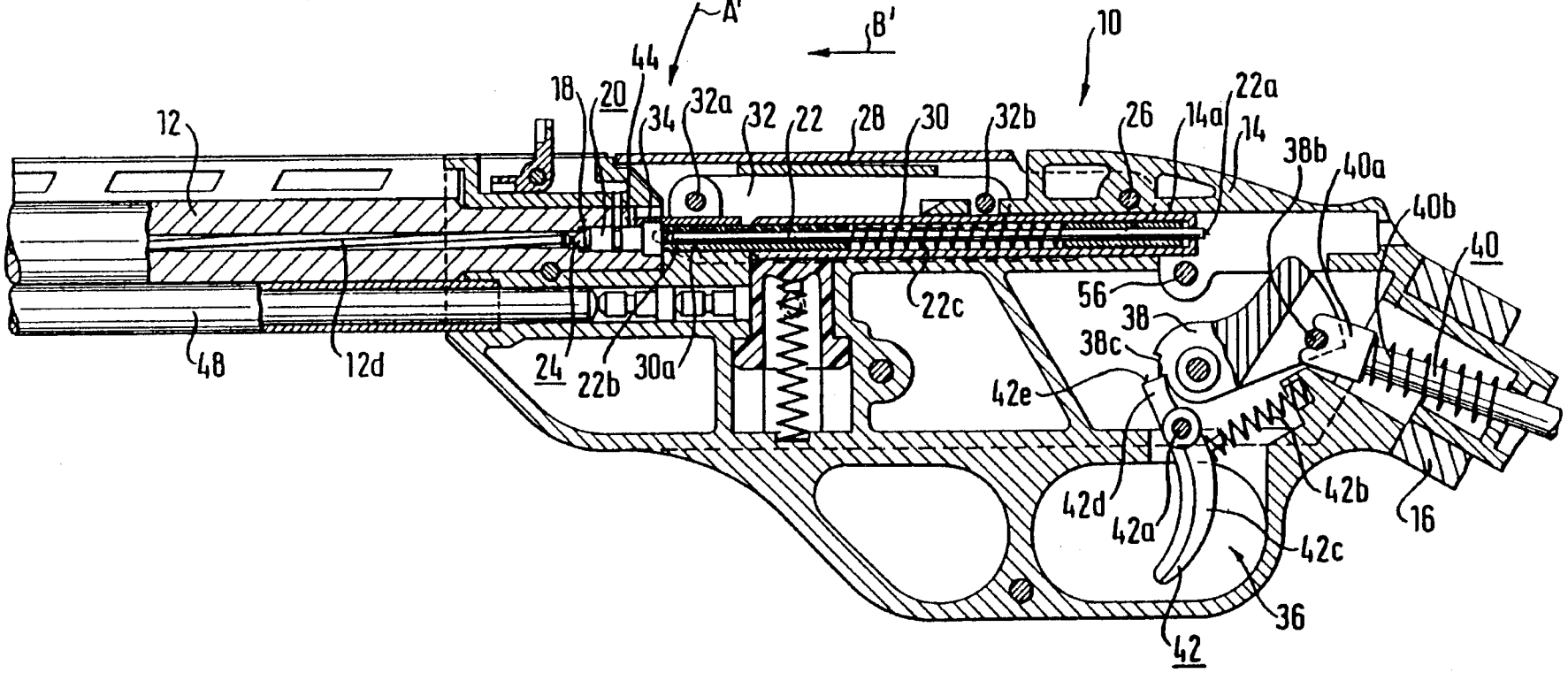
FIG. 4 shows a view similar to FIGS. 1 to 3, of a compressed gas weapon fully loaded and ready to be fired.

Upon displacement of the closure slide 30 in the direction of the arrow B when the loading flap 28 is opened, the hammer 38 is swung clockwise against the action of the spring 40*b*. This causes ratchet teeth 38*c* of the hammer 38 to click past the upper lever arm 42*d* of the trigger 42, whereupon the trigger 42 is swung clockwise by the action of the compression spring 42*b* and a face 42*e* of its upper lever arm 42*d* comes to rest against flanks of the ratchet teeth 38*c*. Owing to this ratchet effect, the hammer 38 is held in the position of readiness to be released as shown in FIG. 4, even after the loading flap 28 has been closed. Now the weapon is in the condition shown in FIG. 2, and can again be reloaded.

Figure 3:
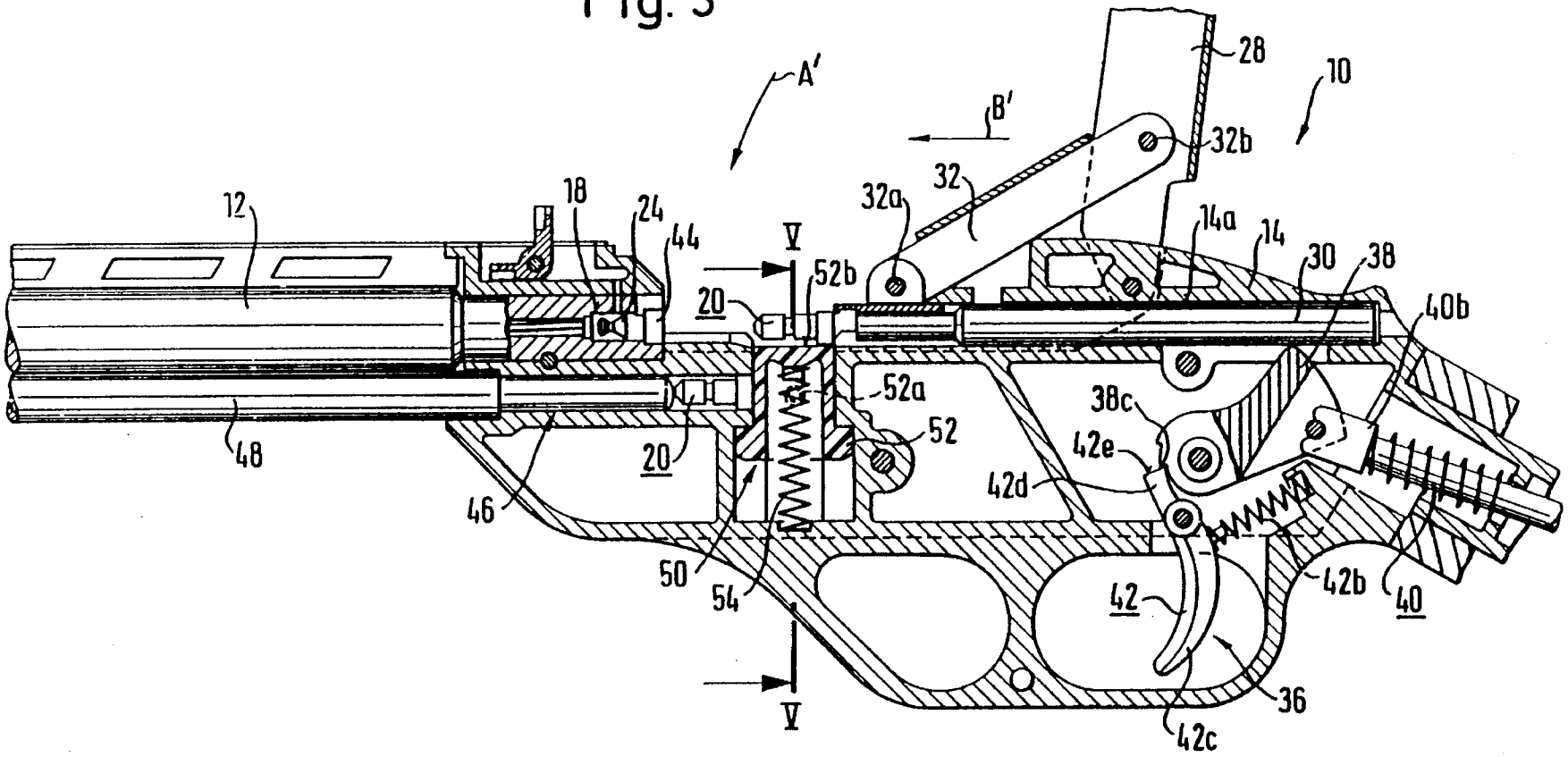
FIG. 3 shows a view similar to FIGS. 1 and 2, during a second stage of loading the compressed gas weapon.

The loading of the weapon will be explained in the following in more detail with reference to FIGS. 2 and 3. In the breech region 18 of the barrel 12, a receiving chamber 44 is fashioned, in which a projectile 24 is placed to load the weapon (see FIG. 3). The receiving chamber 44 is of such configuration that the projectile 24 can be inserted substantially without any deformation. Then it remains to arrange a cartridge 20 behind the projectile 24. The precise configuration of the receiving chamber 44 (otherwise referred to also as the cartridge-receiving or the projectile-receiving chamber) will be discussed more fully later on, in terms of the description of FIGS. 6 and 7.

In the embodiment of the weapon 10 as represented in the figures by way of example, a plurality of cartridges 20 are arranged in a magazine 46 comprising a receptacle 48 arranged under the barrel 12 in firing position of the weapon 10 and a conveying means 50. The plurality of cartridges 20 are arranged one behind another in the receptacle 48 in the axial direction of the barrel 12. The cartridges 20 are urged in the direction towards the conveying means 50 in the receptacle 48 by means of a compression spring not shown in the figures. The conveying means 50 comprises a loading slide 52 and a helical compression spring 54. The spring 54 bears at one end on the breech 14 and at the other end on the loading slide 52, pushing the latter into the raised position represented in FIG. 3.

Figure 5:
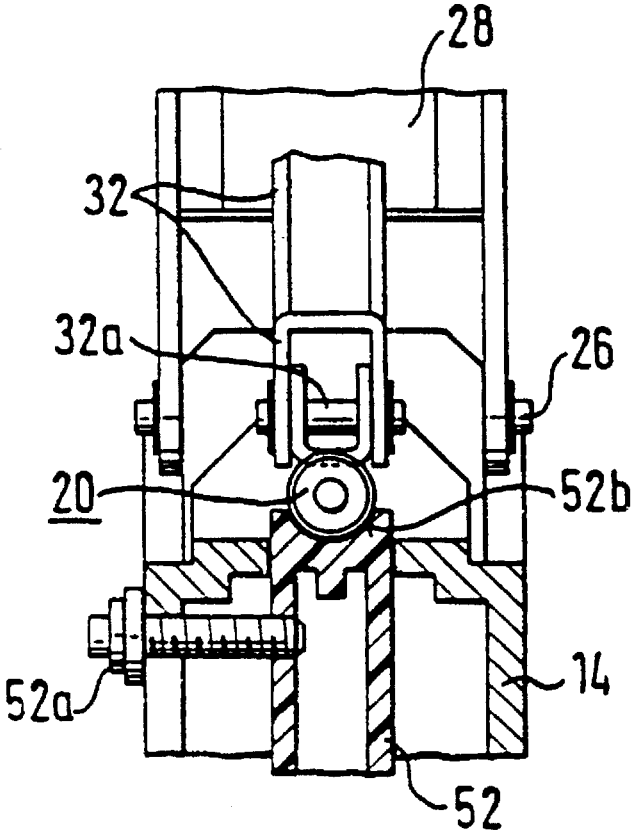
FIG. 5 shows a view at the line V—V in FIG. 3.

To load a cartridge, the loading slide 52 is moved manually against the action of the spring 54 into its lower position as represented in FIG. 2. For this purpose, an operator will actuate a loading slide knob 52*a* arranged on the loading slide 52 and best seen in FIG. 5. If the loading slide 52.is in its lower position as shown in FIG. 2, then the compression spring, not shown, of the receptacle 48 advances the cartridges 20 accommodated in the receptacle 48 by one cartridge length towards the conveying means 50. This places one cartridge 20 in a loading slide trough formed at the upper end of the loading slide 52. Then the loading slide 52 is returned to its upper position as in FIG. 3, in which it is held by the force of the helical compression spring 54. The cartridge 20 arranged in the loading slide trough 52*b* is now immediately in front of the closure slide 30 in its position of readiness to load.

Upon closure of the loading flap 28 (see FIG. 3), i.e. when it is swung in the direction of the arrow A', the closure slide 30 is again shifted in the direction of the arrow B', i.e. towards the barrel 12, by means of the pivoted lever 32. Thus the closure slide 30 carries the cartridge 20 arranged in the loading slide trough 52*b* with it towards the cartridge-receiving chamber 44.

Figure 6:
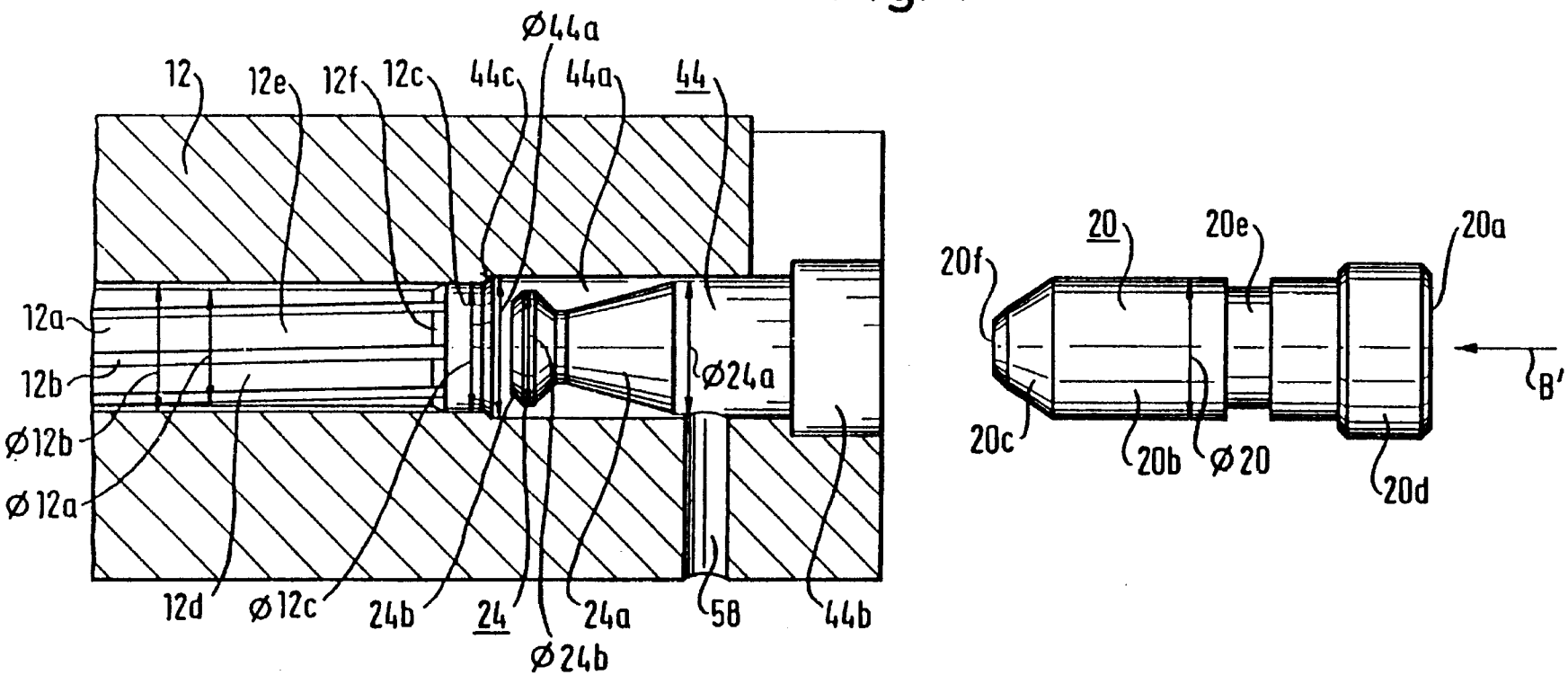
FIGS. 6 and 7 show details to illustrate the reproducible calibering of the projectile when loading the compressed gas weapon according to the invention.
Figure 7:
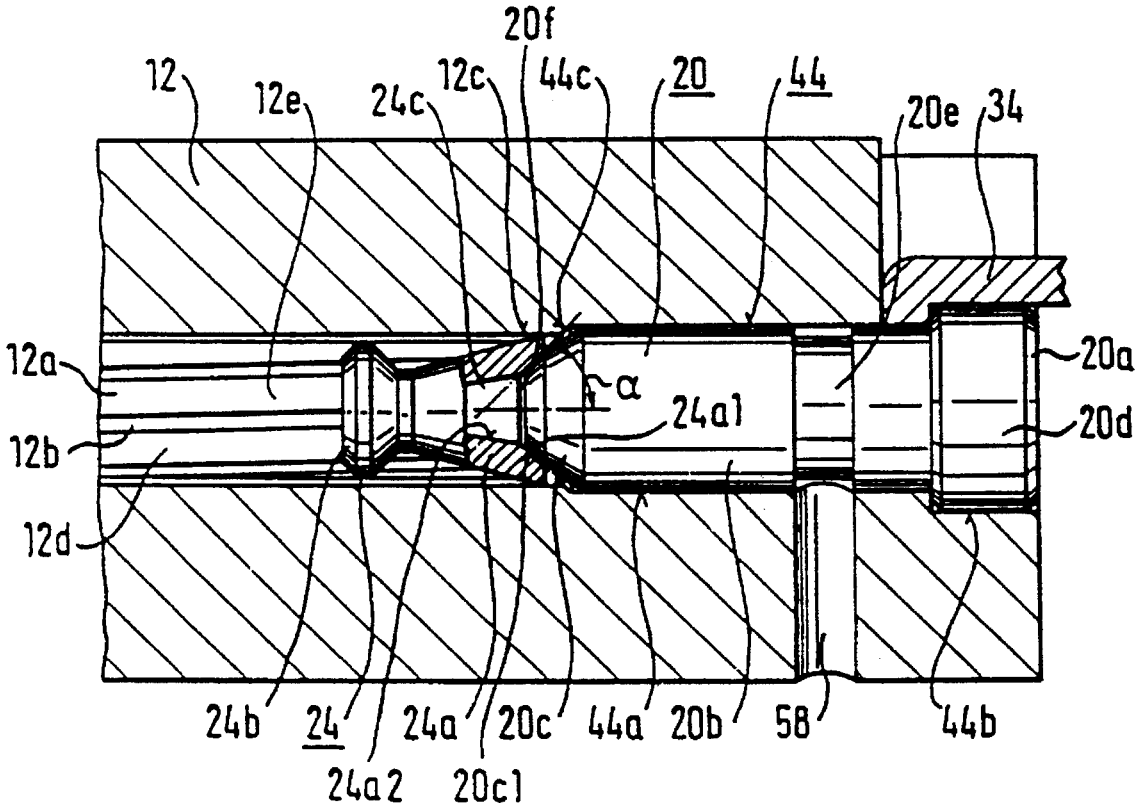

The cartridge-receiving chamber 44 is preferably of symmetrical cylindrical configuration and, as may best be seen in FIGS. 6 and 7, comprises a segment 44*b* radially enlarged relative to a main segment 44*a* at its muzzle-far end. The inside diameter $\phi_{44a}$ of the main segment 44*a* of the cartridge-receiving chamber 44 is slightly oversized relative to the outside diameter $\phi_{20}$ of the main segment of the jacket 20*b* of the cartridge 20, so that the cartridge 20 may be introduced smoothly into the cartridge-receiving chamber. The inside diameter of the enlarged segment 44*b* substantially matches the outside diameter of the collar segment 20*d* of the cartridge head 20*a*. The preferably tapering surfaces of the nose part 20*c* of the cartridge serve as directing and centering surfaces when the cartridge is introduced into the cartridge-receiving chamber 44. Furthermore, the conically tapering surfaces of the nose part 20*c* of the cartridge 20 enter an apron segment 24*a* of the diabolo projectile 24 preferably used with the compressed gas weapon 10, and this in turn contributes to the centering of the diabolo projectile 24.

Upon further introduction of the cartridge 20 into the cartridge-receiving chamber 44, the projectile 24 is now shifted increasingly to the left in FIG. 6 by the cartridge 20. Thus a nose 24*b* of the projectile 24 enters a smooth cylindrical segment 12*c* the bore 12*d* past a tapered annular shoulder 44*c* and arrives finally in a segment 12*e* provided with lands 12*a* and rifling grooves 12*b* of the bore 12*d* .

The inside diameter $\phi_{12b}$ defined by the rifling grooves 12*b* of the segment 12*e* of the bore 12*d* and inside diameter $\phi_{12c}$ of the smooth cylindrical segment 12*c* have the same value, whereas the inside diameter $\phi_{12a}$ of the segment 12*e* of the bore 12*d* as defined by the lands 12*a* has a smaller value than the inside diameter $\phi_{12c}$.

The outside diameter $\phi_{24b}$ of the nose 24*b* is preferably dimensioned slightly smaller than the inside diameter $\phi_{12a}$ of the bore 12*d* as defined by the lands, so that the nose 24*b* of the projectile 24, upon entering the segment 12*e* provided with lands and rifling grooves of the bore 12*d*, will not be deformed. At the transition between the smooth cylindrical segment 12*c* and the lands 12*a*, conical transition surfaces 12*f* are provided, having a centering function for the nose 24*b* of the projectile 24.

The inside diameter $\phi_{12c}$ of the smooth cylindrical segment 12*c* of the bore 12*d* has a smaller value than the inside diameter $\phi_{44a}$ of the main segment 44*a* of the cartridge-receiving chamber 44. The transition between these two diameters $\phi_{12c}$ and $\phi_{44a}$ is formed by the tapered shoulder 44*c*. The maximum outside diameter $\phi_{24a}$ of the apron segment 24*a* of the projectile 24 has a smaller value than the inside diameter $\phi_{44a}$ of the main segment 44*a* of the cartridge-receiving chamber 44, but a greater value than the inside diameter $\phi_{12c}$ of the smooth cylindrical segment 12*c* of the bore 12*d*.

Therefore the apron segment 24*a* of the projectile 24, when introduced into the barrel 12 by means of the cartridge 20, is calibered, that is, slightly deformed, by the shoulder 44*c* in such manner that it is in contact substantially without clearance with the inner periphery of the segment 12*c* of the bore of the barrel 12, as shown for example in FIG. 7. In this position, the cartridge 20 has been introduced completely into the cartridge-receiving chamber 44, any further introduction of the cartridge 20 into the bore 12*d* being prevented because the collar segment 20*d* of the cartridge 20 rests against the shoulder formed between main segment 44*a* and enlarged segment 44*b* of the cartridge-receiving chamber 44.

In the position of readiness to fire (FIG. 7) thus achieved, the apron segment 24*a* of the projectile 24 is lodged between the tapered nose part 20*c* of the cartridge 20 and the tapered transition surfaces 12*f* of the lands 12*a*, the lands 12*a* having already entered slightly into the apron segment 24*a* of the projectile 24. Thus the apron segment 24*a* of the projectile 24 and the tapered nose 20*c* of the cartridge 20 are in sealing contact with each other at tapered boundary surfaces 24*a*1 and 20*c*1 respectively, having the same angle of taper α. Therefore the nozzle 20*f* of the cartridge is directed into a gas reservoir 24*c*, sealed off gastight, in the apron segment 24*a* of the projectile 24.

The position of readiness to fire, represented in FIG. 7, of projectile 24 and cartridge 20, corresponds to the position of the weapon 10 in the condition of readiness to fire as shown in FIG. 4. Now, starting from FIG. 4, if the trigger 42 of the weapon 10 is actuated, i.e. rotated counterclockwise against the action of the spring 42*b*, this will release the engagement between trigger 42 and the ratchet teeth 38*c* of the hammer 38. Thereupon the hammer 38 will be swung counterclockwise by the compression spring 40*b* by way of the hammer rod 40 and strike an end 22*a*, at the right in FIG. 4, of the firing pin 22. The left-hand end 22*b* of the firing pin then strikes the cartridge 20, thus discharging the propellant unit. A pin 56 serves as a stop for the hammer 38 in so doing.

In the embodiment shown by way of example, the firing pin 22 is accommodated in a central bore 30*a* (FIGS. 1 and 4) and is urged to the right in the figures by a firing pin spring 22*c*.

Owing to the discharge of the propellant unit, gas will evolve and build up pressure in the cartridge. This will press the jacket 20*b* of the cartridge 20 firmly against the inner periphery of the main segment 44*a* of the cartridge-receiving chamber 44, so that the cartridge-receiving chamber 44 is obturated towards its muzzle-far end. Thus it is ensured that only after this sealing effect has been built up, will the gas emerging from the nozzle 20*f* of the cartridge 20 accelerate the projectile 24 towards the muzzle of the barrel 12, eliminating the seal between the taper surfaces 24*a*1 and 20*c*1. In the course of the acceleration of the projectile 24, the lands 12*a* of the barrel 12 will be pressed into its apron segment 24*a*, so that the portions of the apron segment 24*a* guided in the rifling grooves 12*b* of the barrel 12 will serve to impart spin to the projectile 24.

As may be seen especially in FIGS. 6 and 7, the cartridge 20 has a weakened area 20*e* in the form of a reduced jacket segment, facing a passage 58 branching off from the cartridge-receiving chamber 44 when in position as in FIG. 7. The passage 58 is preferably made in the form of a drilled hole placing the cartridge-receiving chamber 44 in communication with the surroundings. The weakened area 20*e* is intended to prevent the possibility of achieving higher than maximum projectile energy as allowed by statute by tampering with the cartridges 20. If a cartridge 20 is prepared in such a way as to boost the power of its propellant unit, leading to a correspondingly intensified evolution of gas upon discharge, the weakened area will burst when the gas pressure in the cartridge 20 exceeds a maximum allowable value, and the gas pressure is released to the surroundings by way of the hole 58.

It should be recalled again that projectiles 24 can be reproducibly brought into one and the same position of readiness to fire by means of the loading operation above described. All individual influences of the operator loading the compressed gas weapon 10 can be effectively excluded. The projectile 24 can be placed in the cartridge-receiving chamber 44 without being subjected to deformation. Then the cartridge 20, acting as positioning means for the projectile, is introduced into the cartridge-receiving chamber 44 with the aid of the slide means 30, exerting no substantial forces on the projectile 24 until the jacket 20*b* of the cartridge is safely guided in the main segment 44*a* of the cartridge-receiving chamber 44. The tapered nose part 20*c* centers the apron segment 24*a* of the projectile 24. The cartridge 20 pushes the apron segment 24*a* of the projectile 24 past the calibering edge 44*c* only after the projectile 24 has been centered. This secures the reproducible calibering of the projectile 24, so that like initial conditions are provided for every shot fired. In this way a better and more uniform pattern can be fired with the compressed gas weapon 10.

It should be recalled also that the compressed gas weapon 10, by virtue of the flexible configuration of the jacket 20*b* of the cartridge 20, dispenses with any separate sealing element between barrel 12 and the rest of the weapon 10, since the gas pressure generated upon discharge of the cartridge 20 presses the cartridge jacket into contact with the inner peripheral surface of the cartridge-receiving chamber 44 and automatically obturates the muzzle-far portion 18 of the barrel 12. The total energy released upon discharge of the cartridge 20 is utilized to accelerate the projectile 24. Owing to the automatic obturation of the barrel 12, the compressed gas weapon 10 according to the invention may be of simple construction.

Figure 8:
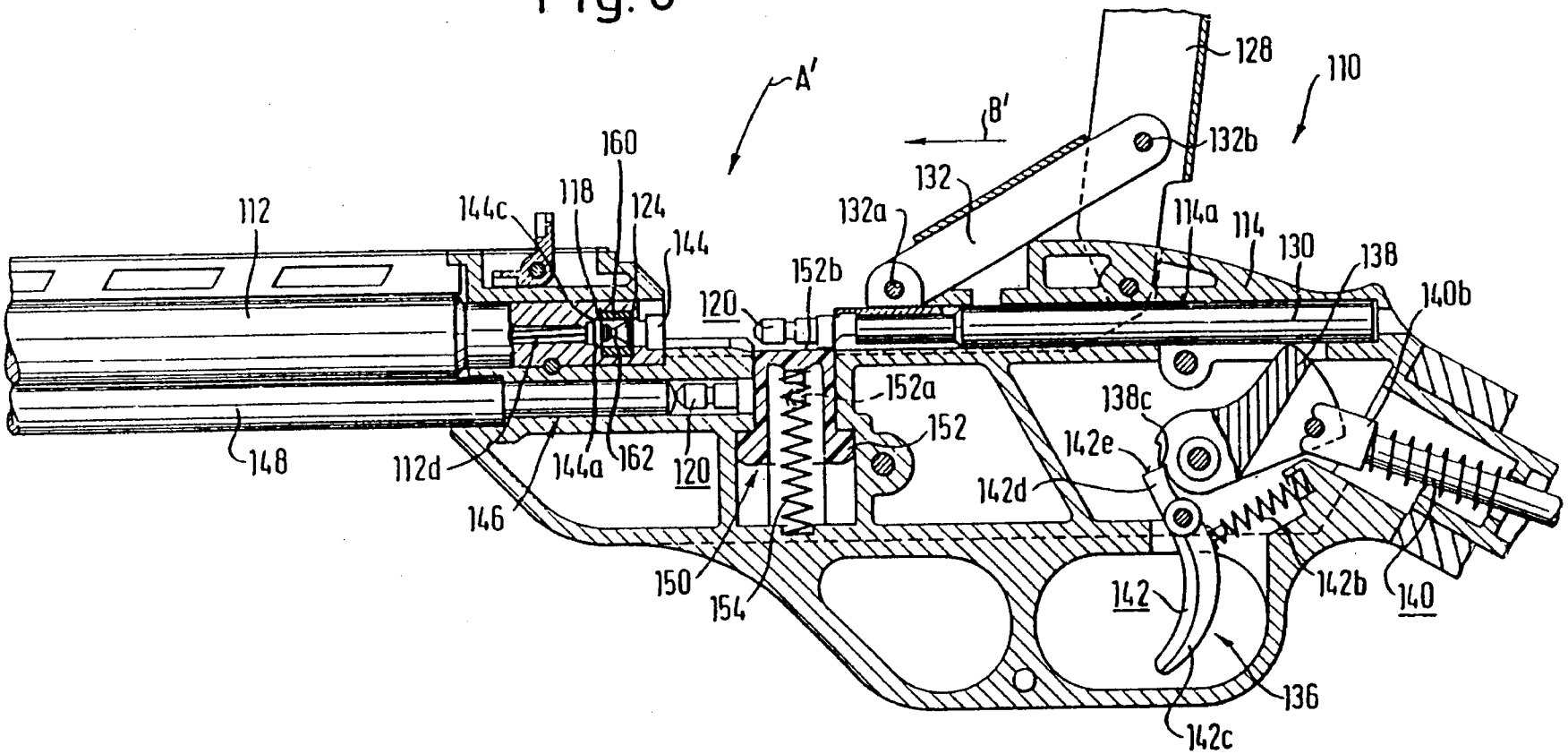
FIG. 8 shows a sectional side view of a second embodiment of the compressed gas weapon according to the invention, with a magazine for projectiles arranged transverse to the direction of the bore, and a magazine for cartridges arranged in the direction of the bore.

FIG. 8 shows another embodiment of the compressed gas weapon according to the invention, substantially similar to the compressed gas weapon represented in FIGS. 1 to 7. In FIG. 8, therefore, parts are assigned reference numerals corresponding to those in FIGS. 1 to 7, but increased by the number 100. In the following, the compressed gas weapon of FIG. 8 will be described only insofar as it differs from the compressed gas weapon of FIGS. 1 to 7. Regarding the other component parts and their functions, reference is here expressly made to the description of FIGS. 1 to 7.

The compressed gas rifle 110 of FIG. 8 differs from the compressed gas rifle 10 of FIGS. 1 to 7 only in that, in addition to the magazine 146 for cartridges 120, a magazine 160 for projectiles 124 is provided as well, by means of which the projectiles 24 can be introduced successively into the cartridge-receiving chamber 144. The projectile magazine 160 is arranged horizontally, i.e. transversely to the direction of the barrel. The magazine 160 comprises a plurality of magazine bores 162, each of which accommodates a projectile 124 and whose inside diameter has the same value as the inside diameter $\varnothing_{44a}$ of the main segment 144*a* of the cartridge-receiving chamber 144.

The only difference in loading the compressed gas rifle 110 compared to loading the compressed gas rifle 10 consists in that the projectile 124 is not placed manually in the cartridge-receiving chamber 144; instead, a magazine bore 162 with the projectile 124 in place therein is brought into alignment with the main segment 144*a* of the cartridge-receiving chamber 144 with the aid of the magazine. Then, as in the case of the compressed gas weapon 10, the projectile 124 is introduced into the bore 112*d* of the barrel 112 by means of the cartridge 120, at the same time calibering it at the shoulder 144*c*. Owing to the equality of inside diameter of the magazine bore 162 and the cartridge-receiving chamber 144, it is ensured that the apron segment of the projectile 124 will not be deformed at the transition from magazine bore to cartridge-receiving chamber, but only by the shoulder 144*c*.

Figure 9:
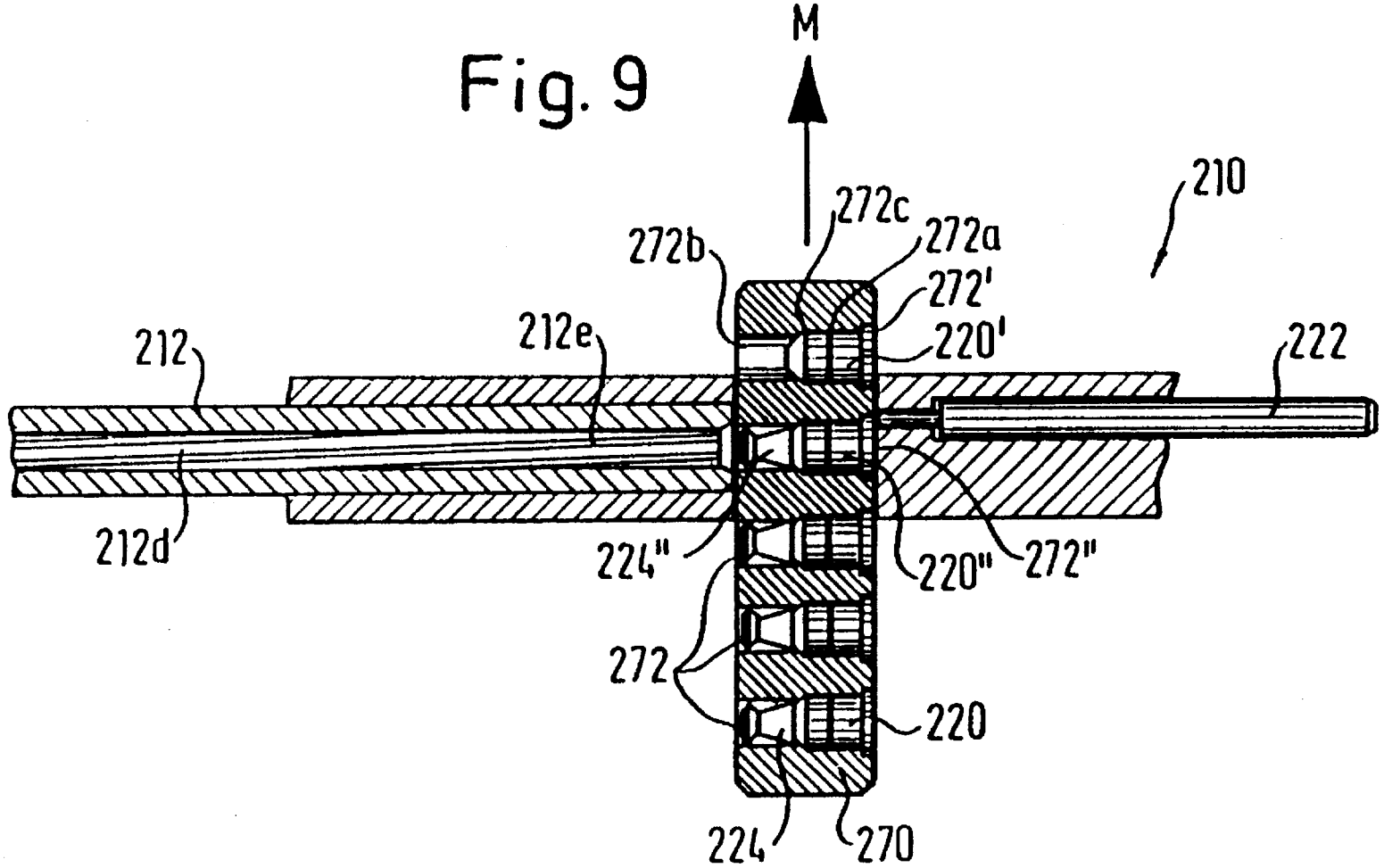
FIG. 9 shows a schematic sectional side view of yet another embodiment of the compressed gas weapon according to the invention, with a magazine for projectiles and cartridges arranged transverse to the direction of the bore.

FIG. 9 schematically shows a third embodiment of the compressed gas weapon according to the invention, substantially similar to the compressed gas weapon shown in the preceding figures. Hence similar parts are assigned reference numerals in FIG. 9 that correspond to those in FIGS. 1 to 7, but increased by the number 200. The compressed gas weapon of FIG. 9 will be described in the following only insofar as it differs from the compressed gas weapons previously described. Regarding the other parts and their functions, reference is here expressly made to the above description of the embodiment shown in FIGS. 1 to 7.

The compressed gas rifle 210 of FIG. 9 differs from the compressed gas rifle 110 of FIG. 8 in that, instead of the magazine 160 for projectiles 124, a magazine 270 is provided in which both projectiles 244 and cartridges 220 are accommodated. The magazine 270 comprises a plurality of magazine bores 272. The magazine bores 272 each exhibit a first segment 272*a* of identical configuration with the cartridge-receiving chamber 44 of the embodiment of FIGS. 1 to 7, as well as a second segment 272*b* of identical configuration with the smooth cylindrical segment 12*c* of the bore 12*d* of the embodiment of FIGS. 1 to 7. Between the first and second segments 272*a* and 272*b*, a tapered shoulder 272*c* is formed. In the direction of firing, the magazine 270 is followed immediately by a rifled segment 212*e* of the bore 212*d*.

To load the magazine 270, first a projectile 224 is placed manually in a magazine bore 272, its apron segment coming to rest against the shoulder 272*c*. By virtue of the configuration of the first segment 272 as described above, there is no danger here of any deformation of the projectile 224. Then a cartridge 220 is introduced into the first segment 272*a*. This first centers the projectile 224 by its tapered nose segment and then pushes it into the second segment 272*b* of the magazine bore 272, while the projectile 224 calibers itself on the shoulder 272*c*.

When a shot has been fired from the magazine bore 272' the magazine 270 is shifted into direction of the arrow M until the next magazine bore 272" comes into alignment with the bore 212*d*. The spent cartridge 220' is still in the magazine bore 272'. To fire the next shot, the firing pin 222 strikes the edge of the posterior end of the cartridge 220", discharging its propellant unit (the cartridges 220 are rim-firing, whereas the cartridges 20 and 120 are of center-firing type). Owing to the resulting evolution of compressed gas, the projectile 224" is accelerated out of the second segment 272*b*into the rifled segment 212*e* of the bore 212*d*.

Figure 10:
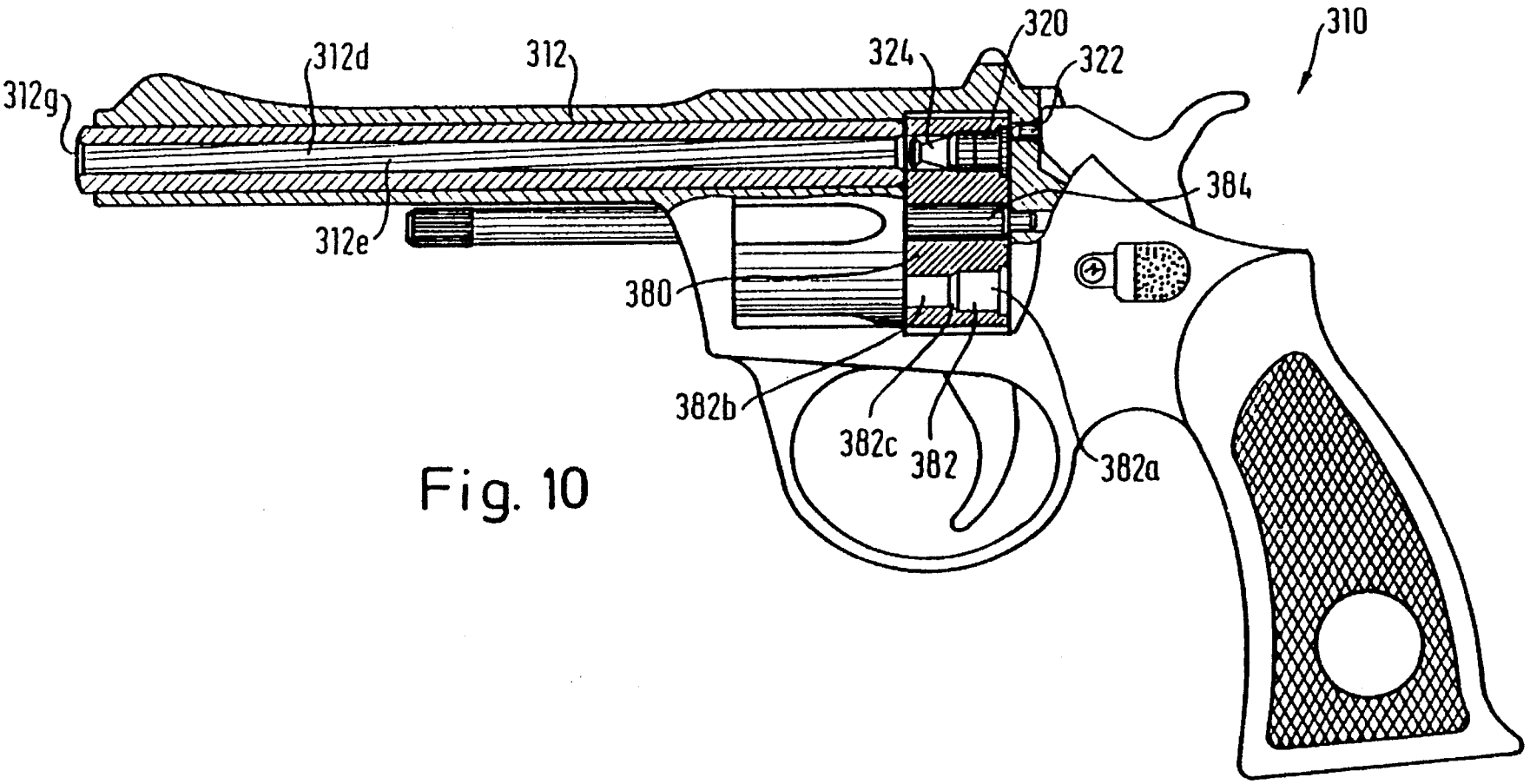
FIG. 10 shows a side view, partially in section, of a compressed gas revolver according to the invention, with a cylinder magazine for projectiles and cartridges.

FIG. 10 shows a fourth embodiment of the compressed gas weapon according to the invention. The fourth embodiment is substantially similar to the embodiments described above and shown in FIGS. 1 to 9. Corresponding parts in FIG. 10 are therefore assigned reference numerals corresponding to those in FIGS. 1 to 7, but increased by the number 300. In the following, the compressed gas weapon according to FIG. 10 will be described only insofar as it differs from the compressed gas weapons previously described. Regarding the other parts and their functions, reference is here expressly made to the description of FIGS. 1 to 7.

The compressed gas weapon of FIG. 10 has the configuration of a revolver 310 with cylinder magazine 380 mounted rotatably about a shaft 384 arranged in longitudinal direction of the barrel 312. The cylinder magazine 380 comprises a plurality of magazine bores 382 having first and second segments 382*a* and 382*b* of identical configuration with the first and second segments 282*a* and 282*b* of the magazine 280. The first and second segments 382*a* and 382*b* meet in tapered transitions 382*c* in each instance.

The loading of the magazine 380 with projectiles 324 and cartridges 320, and the firing of the weapon, proceed in the manner described above for the example of the compressed gas weapon 210. In the compressed gas revolver 310 likewise, rim-fire cartridges 320 are employed.

The revolver may instead be devised with a swing magazine. In the swing type, the spent cartridges must be removed manually with an ejector, whereas in the breaking type they are automatically ejected by opening.

Again, it is possible to configure the compressed gas weapon as a pistol having an insertion magazine for projectile-cartridge units.

The advantage of the automatic obturation of the bore by the cartridge configuration with an elastic jacket and the associated simple structure of the compressed gas weapon may for example be utilized also if, instead of the diabolo projectile, a means of self defense is inserted, for example a tear-gas cartridge or the like. It is also conceivable that the compressed gas weapon may be adapted for home handiwork, pest control or safety purposes.

Besides, the compressed gas weapon according to the invention can be built light in weight, since many component parts may be made of plastic, aluminum or the like.

It should be added that the diabolo projectiles 24, best represented in FIGS. 6 and 7, or at least their apron segments 24*a*, are made of lead, a lead alloy, or some other suitably soft material. In this way the apron segment 24*a* is provided with the deformability required for calibering of the projectile 24 on the shoulder 44*c* and for pressing the apron segment 24*a* into the rifling 12*b* and lands 12*a* of the barrel 12. The diabolo projectiles 24 are regularly manufactured in the calibers of 4.5, 5.5 and 6.33 mm only. It is to be borne in mind further that the cone angle $\alpha$, which plays a decisive part in centering the diabolo projectile 24, commonly has a value between 30° and 45°.

The characteristic form of the diabolo projectiles 24, namely nose-waist-apron, the waist having a distinctly smaller diameter than the nose 24*b* or the apron segment 24*a*, makes possible an especially effective centering of the said diabolo projectile 24 upon engagement of the tapered nose part 20*c* of the cartridge in the apron segment 24*a* of the projectile 24. The solid nose 24*b* of the diabolo projectile 24 in this case acts as a pivot bearing for the apron segment 24*a*, or as a point about which the apron segment 24*a* revolves in centering itself.

The result that the projectile 24, upon firing, is accelerated towards the muzzle of the barrel 12 by the gas emerging from the nozzle 20*f* of the cartridge 20 only after the sealing effect between the cartridge jacket 20*b* and the cartridge-receiving chamber 44 has been achieved may be brought about in simple manner by closure of the nozzle 20*f* of the cartridge 20 by means of a membrane (not shown). This membrane is ruptured by the gas pressure building up in the expansion chamber within the jacket 20*b* of the cartridge 20 only when a pressure limit determined by the configuration of the membrane is transgressed. Then the compressed gas expands in the gas reservoir 24*c* in the apron segment 24*a* of the projectile 24 and accelerates the latter towards the muzzle of the barrel 12. So that the pressure drop occurring as a result of the expansion of the compressed gas in the gas reservoir 24*c* will not lead to elimination of the sealing effect between the cartridge jacket 20*b* and the cartridge-receiving chamber 44, the volume ratio of the expansion chamber within the jacket 20*b* to the gas reservoir 24*c* is at least 10:1, preferably at least 20:1. The volume of the expansion chamber within the jacket 20*b* is about 100 $mm^3$.

It may again be brought out distinctly at this point that after rupture of the membrane provided in the nozzle 20*f* and expansion of the compressed gas out of the expansion chamber within the jacket 20*b* into the gas reservoir 24*c*, the seal towards the muzzle-far end of the barrel 12 is secured by the contact of the flexible cartridge jacket with the inner wall of the cartridge-receiving chamber 44, and the seal towards the muzzle of the barrel 12 is secured by the contact of the apron 24*a*, optimally adapted by calibering to the form of the barrel 12, of the diabolo projectile 24 with the smooth cylindrical segment 12*c* of the barrel 12. The achievement of the latter sealing effect especially is facilitated by the preferably soft metallic material of the diabolo projectile.

It should be noted further that the closure slide 30 secures the cartridge 20 in completely loaded condition ready to fire, as represented for example in FIG.4, by contact therewith against a motion directed contrary, i.e. to the right in FIG. 4, to the direction of fire.

It should be noted further that the sealing effect according to the invention may alternatively be achieved and secured by the following configuration of the cartridge 20. In this configuration, the cartridge 20, in its posterior region, i.e. the segment adjacent to the weakened area 20*e* away from the nozzle 20*f* and including the collar 20*d*, is made of sheet brass or a material of similar mechanical properties, and the anterior region of the cartridge 20, i.e. the segment comprising the weakened area 20*e*, the wall of the expansion chamber of the jacket 20*b* and the cone 20*c*, is made of plastic.

Lastly, it should be noted that the barrel 12 of the compressed gas weapon 10 is made in one single piece. This piece comprises the barrel segment featuring the rifling 12*b* and lands 12*a*, from the muzzle to the cartridge-receiving chamber 44, the multiply stepped segment in the region of the calibering shoulder 44*c* and the segment featuring the cartridge-receiving chamber 44 as far as the radially enlarged breech portion 44*b* of the cartridge-receiving chamber 44. By virtue of this one-piece configuration of the barrel 12, sealing problems in the region of the diabolo projectile 24 when the shot is fired can be avoided in simple manner.

I claim:

1. A compressed gas weapon system comprising a firing mechanism having a bore with an axis and a projectile exit end and defined by at least one member, a projectile, a compressed gas generating cartridge usable for a single shot, said compressed gas generating cartridge containing a propellant for generating a compressed gas for providing a gas pressure for propelling the projectile axially of the bore in a direction of firing towards the projectile exit end and being provided in its interior with an expansion chamber for homogenizing the gas pressure, and a trigger mechanism adapted to cause the compressed gas generating cartridge to generate the compressed gas, said bore having, at an axial distance from the projectile exit end, an entrance for the projectile and the compressed gas generating cartridge, a cartridge-receiving chamber proximate to the entrance, and a projectile-receiving chamber adjacent an anterior end of the cartridge-receiving chamber with respect to the direction of firing, the chambers accommodating, in a position of readiness to fire of the compressed gas weapon system, the cartridge in a position behind the projectile with respect to the direction of firing of the projectile, the projectile having with respect to the direction of firing an anterior end, a nose portion adjacent the anterior end, a posterior end and an apron portion adjacent the posterior end, the apron portion of the projectile having a diameter that is greater than the diameter of the nose portion and greater than the diameter of a part of the projectile-receiving chamber that receives the apron portion when the projectile is received in the projectile-receiving chamber so that the diameter of the apron portion of the projectile is reduced to caliber the projectile, the posterior end of the projectile having a cavity, and the cartridge having at its anterior end with respect to the direction of firing a tapered projection, the cavity of the projectile and the tapered projection of the cartridge being, in the position of readiness to fire, in mutual abutment over at least a part of their axial lengths by respective conical surfaces of the cavity and the projection, the tapered projection of the cartridge having a gas exit orifice opening, in the position of readiness to fire, into the cavity of the projectile, and the cartridge being formed at least partly of plastic so as to be expandable and having an outside diameter so matched to an inside diameter of the cartridge-receiving chamber that the cartridge can be smoothly introduced into the cartridge-receiving chamber, and can, under the action of the gas pressure building up in the expansion chamber, expand into gas-tight contact with an inner peripheral surface of the cartridge-receiving chamber.

2. A compressed gas weapon system according to claim 1, wherein the bore further includes lands and rifling grooves, the lands of the bore engaging, in the position of readiness to fire, the apron portion of the projectile.

3. A compressed gas weapon system according to claim 1, wherein the conical surfaces of the cavity and the tapered projection have the same cone angle over at least a portion of their axial lengths.

4. A compressed gas weapon system according to claim 1, wherein the cartridge is positioned in the axial direction of the bore by a stop.

5. A compressed gas weapon system according to claim 1, wherein the inside diameter of the cartridge-receiving chamber slightly exceeds the maximum diameter of the projectile so that the projectile is smoothly insertable in the cartridge-receiving chamber through the entrance to the bore, the projectile being capable of being pushed into the projectile-receiving chamber and to be calibered when the compressed gas generating cartridge is introduced into the cartridge-receiving chamber.

6. A compressed gas weapon system according to claim 1, wherein the bore has a tapered transition shoulder between the cartridge-receiving chamber and the projectile-receiving chamber.

7. A compressed gas weapon system according to claim 1, wherein the projectile-receiving chamber has a smooth cylindrical segment adjacent to the anterior end of the cartridge-receiving chamber, the bore has lands and rifling grooves extending from the smooth cylindrical segment to the exit end, and in the position of readiness to fire the nose portion of the projectile is received within the lands and rifling grooves and the apron portion of the projectile is received by the smooth cylindrical segment of the bore.

8. A compressed gas weapon system according to claim 7, wherein the bore is provided with lands and rifling grooves, bases of the rifling grooves being aligned with the inner periphery of the smooth cylindrical segment, and the lands located between the rifling grooves projecting slightly radially inward relative to the smooth cylindrical segment and merging by way of conical transition surfaces into the smooth cylindrical segment.

9. A compressed gas weapon system according to claim 8, wherein the outside diameter of the nose portion of the projectile is smaller than the diameter of the segment provided with the rifling grooves as defined by the lands.

10. A compressed gas weapon system according to claim 1, wherein the projectile is a diabolo-type projectile.

11. A compressed gas weapon system according to claim 1, wherein the firing mechanism includes a firing pin.

12. A compressed gas weapon system according to claim 1, wherein a magazine is provided for the projectiles.

13. A compressed gas weapon system according to claim 12, wherein the magazine is advanceable to bring the projectiles into the position of readiness to fire successively.

14. A compressed gas weapon system according to claim 12, wherein the magazine is advanceable to bring the projectiles into a position of readiness for introduction successively.

15. A compressed gas weapon system according to claim 14, wherein conveying means are provided to bring the projectiles out of the position of readiness for introduction into the position of readiness to fire.

16. A compressed gas weapon system according to claim 1, wherein a magazine is provided for the compressed gas generating cartridges.

17. A compressed gas weapon system according to claim 16, wherein the magazine is advanceable to bring the compressed gas generating cartridges into a position of of readiness to fire successively.

18. A compressed gas weapon system according to claim 16, wherein the magazine is advanceable to bring the compressed gas generating cartridges into a position of readiness for introduction successively.

19. A compressed gas weapon system according to claim 18, wherein conveying means are provided to bring the compressed gas generating cartridges out of the position of readiness for introduction into the position of readiness to fire.

20. A compressed gas weapon system according to claim 16 wherein the magazine includes a receptacle in which the compressed gas generating cartridges are received one behind another in alignment in a direction generally parallel to the axis of the bore.

21. A compressed gas weapon system according to claim 1, wherein a magazine is provided for accommodating both projectiles and compressed gas generating cartridges.

22. A compressed gas weapon system according to claim 21, wherein the magazine is advanceable to bring the projectiles and the compressed gas generating cartridges into the position of readiness to fire successively.

23. A compressed gas weapon system according to claim 21, wherein the magazine is advanceable to bring the projectiles and the compressed gas generating cartridges into a position of readiness for introduction successively.

24. A compressed gas weapon system according to claim 23, wherein conveying means are provided to bring the projectiles and the compressed gas generating cartridges out of the position of readiness for introduction into the position of readiness to fire.

25. A compressed gas weapon system according to claim 1, wherein the bore, including the cartridge-receiving chamber and the projectile-receiving chamber, are defined by a single barrel member made in one piece.

26. A compressed gas weapon system according to claim 1, and further comprising positioning means for conveying the projectile into the position of readiness to fire.

27. A compressed gas weapon system according to claim 26, wherein a calibering edge is provided between the cartridge-receiving chamber and the projectile-receiving chamber, the projectile being moved by the positioning means over the calibering edge in being conveyed into the position of readiness to fire in the projectile-receiving chamber so as to caliber it.

28. A compressed gas weapon system according to claim 26, wherein the positioning means includes a member guided in the axial direction of the bore and engageable with the cartridge to convey the cartridge and the projectile into the position of readiness to fire.

29. A compressed gas weapon system according to claim 28, wherein the positioning means is slidable along guiding surfaces of a housing member of the compressed gas weapons system.

30. A compressed gas weapon system according to claim 28, wherein the cartridge-receiving chamber, the positioning means and the projectile are so adapted to each other in configuration that the positioning means is precisely guided in the axial direction of the bore before it conveys the projectile into the position of readiness to fire.

31. A compressed gas weapon system according to claim 30, wherein the positioning means is received in guiding relation on a housing of the compressed gas weapon system.

32. A compressed gas weapon system according to claim 26, wherein the positioning means includes the compressed gas generating cartridge.

33. A compressed gas weapon system according to claim 32, wherein the positioning means further includes a slide means displaceable back and forth in the axial direction of the bore for sliding the compressed gas generating cartridge from a position of readiness to load into a position of readiness to fire, said compressed gas generating cartridge in the position of readiness to fire holding the projectile in its position of readiness to fire.

34. A compressed gas weapon system according to claim 33, wherein the slide means is operatively connected to a loading flap of the compressed gas weapon system in such manner that when the loading flap is opened in order to place the projectile in the cartridge-receiving chamber, the slide means is shifted away from the cartridge-receiving chamber, and when the loading flap is closed, the slide means is shifted towards the cartridge-receiving chamber.

35. A compressed gas weapon system according to claim 33, wherein the slide means includes a hook element is arranged, which upon opening of a loading flap of the compressed gas weapon system extracts a spent compressed gas generating cartridge from the cartridge-receiving chamber after a shot has been fired.

36. A compressed gas weapon system according to claim 33, wherein the slide means includes a firing pin for discharging the compressed gas generating cartridge.

37. A compressed gas weapon system according to claim 1, wherein the compressed gas generating cartridge is introduced into the cartridge-receiving chamber separately from the projectile.

38. A compressed gas weapon system according to claim 1, wherein the projectile and the compressed gas generating cartridge are provided as a unit.

39. A compressed gas weapon system according to claim 1, wherein a passage branches off from the cartridge-receiving chamber, by way of which the cartridge-receiving chamber is in communication with the surroundings, and wherein the compressed gas generating cartridge has a weakened area which, in the position of readiness to fire, faces the passage.

40. A compressed gas weapon system comprising a firing mechanism having a bore with an axis and a projectile exit end and defined by at least one member, a projectile, a compressed gas generating cartridge for generating a compressed gas for providing a gas pressure for propelling the projectile axially of the bore in a direction of firing towards the projectile exit end, said bore having, at an axial distance from the projectile exit end, an entrance for the projectile and the compressed gas generating cartridge, a cartridge-receiving chamber proximate to the entrance, and a projectile-receiving chamber adjacent an anterior end of the cartridge-receiving chamber with respect to the direction of firing, the chambers accommodating, in a position of readiness to fire of the compressed gas weapon system, the cartridge in a position behind the projectile with respect to the direction of firing of the projectile, the projectile being insertable substantially without deformation into the cartridge-receiving chamber, the compressed gas generating cartridge during its insertion into the cartridge-receiving chamber transferring the projectile into the position of readiness to fire, the projectile being calibered during this transfer, and slide means displaceable back and forth in the axial direction of the bore for sliding the compressed gas generating cartridge from a position of readiness to load into a position of readiness to fire, said compressed gas generating cartridge in the position of readiness to fire holding the projectile in the position of readiness to fire, the slide means being operatively connected to a loading flap of the compressed gas weapon system in such manner that when the loading flap is opened in order to place the projectile in the cartridge-receiving chamber, the slide means is shifted away from the cartridge-receiving chamber, and when the loading flap is closed, the slide means is shifted towards the cartridge-receiving chamber.

41. A compressed gas weapon system comprising a firing mechanism having a bore with an axis and a projectile exit end and defined by at least one member, a projectile, a compressed gas generating cartridge for generating a compressed gas for providing a gas pressure for propelling the projectile axially of the bore in a direction of firing towards the projectile exit end, said bore having, at an axial distance from the projectile exit end, an entrance for the projectile and the compressed gas generating cartridge, a cartridge-receiving chamber proximate to the entrance, and a projectile-receiving chamber adjacent an anterior end of the cartridge-receiving chamber with respect to the direction of firing, the chambers accommodating, in a position of readiness to fire of the compressed gas weapon system, the cartridge in a position behind the projectile with respect to the direction of firing of the projectile, the projectile being insertable substantially without deformation into the cartridge-receiving chamber, the compressed gas generating cartridge during its insertion into the cartridge-receiving chamber transferring the projectile into the position of readiness to fire, the projectile being calibered during this transfer, and slide means displaceable back and forth in the axial direction of the bore for sliding the compressed gas generating cartridge out of a position of readiness to load into a position of readiness to fire, said compressed gas generating cartridge in the position of readiness to fire holding the projectile in the position of readiness to fire, the slide means including a hook element which upon opening of a loading flap of the compressed gas weapon system extracts a spent compressed gas generating cartridge from the cartridge-receiving chamber after a shot has been fired.

42. A compressed gas weapon system comprising a firing mechanism having a bore with an axis and a projectile exit end and defined by at least one member, a projectile, a compressed gas generating cartridge for generating a compressed gas for providing a gas pressure for propelling the projectile axially of the bore in a direction of firing towards the projectile exit end, said bore having, at an axial distance from the projectile exit end, an entrance for the projectile and the compressed gas generating cartridge, a cartridge-receiving chamber proximate to the entrance, and a projectile-receiving chamber adjacent an anterior end of the cartridge-receiving chamber with respect to the direction of firing, the chambers accommodating, in a position of readiness to fire of the compressed gas weapon system, the cartridge in a position behind the projectile with respect to the direction of firing of the projectile, the projectile being insertable substantially without deformation into the cartridge-receiving chamber, the compressed gas generating cartridge during its insertion into the cartridge-receiving chamber transferring the projectile into the position of readiness to fire, the projectile being calibered during this transfer, and a magazine receiving a plurality of the compressed gas generating cartridges, the magazine including a receptacle in which the compressed gas generating cartridges are received one behind another in a row aligned substantially parallel to the axis of the bore.

43. A compressed gas weapon system comprising a firing mechanism having a bore with an axis and a projectile exit end and defined by at least one member, a projectile, a compressed gas generating cartridge for generating a compressed gas for providing a gas pressure for propelling the projectile axially of the bore in a direction of firing towards the projectile exit end, said bore having, at an axial distance from the projectile exit end, an entrance for the projectile and the compressed gas generating cartridge, a cartridge-receiving chamber proximate to the entrance, and a projectile-receiving chamber adjacent an anterior end of the cartridge-receiving chamber with respect to the direction of firing, the chambers accommodating, in a position of readiness to fire of the compressed gas weapon system, the cartridge in a position behind the projectile with respect to the direction of firing of the projectile, the projectile being insertable substantially without deformation into the cartridge-receiving chamber, the compressed gas generating cartridge during its insertion into the cartridge-receiving chamber transferring the projectile into the position of readiness to fire, the projectile being calibered during this transfer, a passage branching off from the cartridge-receiving chamber, by way of which the cartridge-receiving chamber is in communication with the surroundings, and the compressed gas generating cartridge having a weakened area which, in the position of readiness to fire, faces the passage.

44. A compressed gas weapon system comprising a firing mechanism having a bore with an axis and a projectile exit end and defined by at least one member, a projectile, a compressed gas generating cartridge for generating a compressed gas for providing a gas pressure for propelling the projectile axially of the bore in a direction of firing towards the projectile exit end, said bore having, at an axial distance from the projectile exit end, an entrance for the projectile and the compressed gas generating cartridge, a cartridge-receiving chamber proximate to the entrance, and a projectile-receiving chamber adjacent an anterior end of the cartridge-receiving chamber with respect to the direction of firing, the chambers accommodating, in a position of readiness to fire of the compressed gas weapon system, the cartridge in a position behind the projectile with respect to the direction of firing of the projectile, the inside diameter of the cartridge-receiving chamber slightly exceeding the outside diameter of an apron portion of the projectile, which is the maximum diameter of the projectile, so that the projectile is smoothly insertable into the cartridge-receiving chamber, the inside diameter of the bore being substantially the same as the inside diameter of the cartridge-receiving chamber, and the outside diameter of the apron portion of the projectile being in such matched relationship to the inside diameter of the bore that when the projectile is pushed into the bore by the compressed gas generating cartridge, the outside diameter of the apron portion of the projectile is reduced.

45. A compressed gas weapon system comprising a firing mechanism having a bore with an axis and a projectile exit end and defined by at least one member, a projectile, a compressed gas generating cartridge for generating a compressed gas for providing a gas pressure for propelling the projectile axially of the bore in a direction of firing towards the projectile exit end, said bore having, at an axial distance from the projectile exit end, an entrance for the projectile and the compressed gas generating cartridge, a cartridge-receiving chamber proximate to the entrance, and a projectile-receiving chamber adjacent an anterior end of the cartridge-receiving chamber with respect to the direction of firing, the chambers accommodating, in a position of readiness to fire of the compressed gas weapon system, the cartridge in a position behind the projectile with respect to the direction of firing of the projectile, the projectile-receiving chamber of the bore having in a portion adjacent to the cartridge-receiving chamber a smooth cylindrical segment, the bore having lands and rifling grooves extending from the smooth cylindrical segment to the exit end, an end portion of the projectile anterior with respect to a direction of firing being, in the position of readiness to fire, received within the lands and rifling grooves, and a portion of the projectile posterior with respect to the direction of firing being received in the smooth cylindrical segment of the bore.

46. A compressed gas weapon system according to claim 45, wherein the bases of the rifling grooves are substantially flush with the inner periphery of the smooth cylindrical segment, and the lands located between the rifling grooves project slightly radially inwardly relative to the smooth cylindrical segment and merge by way of conical transition surfaces into the smooth cylindrical segment.

47. A compressed gas weapon system according to claim 46, wherein the outside diameter of the end portion of the projectile anterior with respect to the direction of firing is slightly smaller than the diameter of the bore at the lands.

* * * * *

UNITED STATES PATENT AND TRADEMARK OFFICE

CERTIFICATE OF CORRECTION

PATENT NO. : 5,565,642

DATED : October 15, 1996

INVENTOR(S) : Walter Heitz

It is certified that error appears in the above-indentified patent and that said Letters Patent is hereby corrected as shown below:

Col. 1, line 65, "edge fashioned" should read --edge--;
Col. 1, line 66, "of of" should read --of--;
Col. 15, line 54, "a position of of" should read --the position of--;
Col. 17, lines 4-5, "is arranged" should be deleted.

Signed and Sealed this

Eleventh Day of March, 1997

Bruce Lehman

*Attest:*

BRUCE LEHMAN

*Attesting Officer*

*Commissioner of Patents and Trademarks*